US005440886A

United States Patent [19]

Malakeev et al.

[11] Patent Number: 5,440,886

[45] Date of Patent: Aug. 15, 1995

[54] METHOD OF GAS GENERATION AND PLANT FOR EFFECTING SAME

[75] Inventors: Alexandr K. Malakeev; Alexandr I. Kuzin; Vladimir K. Malakeev, all of Voronezh, Russian Federation

[73] Assignee: Tovarischestvo s ogranichennoi otvetstvennostju, firma "MEGMA ARS" (MEGMA ARS Ltd), Voronezh, Russian Federation

[21] Appl. No.: 204,138

[22] PCT Filed: Apr. 14, 1992

[86] PCT No.: PCT/RU92/00076

§ 371 Date: Feb. 25, 1994

§ 102(e) Date: Feb. 25, 1994

[87] PCT Pub. No.: WO93/21470

PCT Pub. Date: Oct. 28, 1993

[51] Int. Cl.[6] ..... F17C 9/02

[52] U.S. Cl. ..... 62/50.2; 62/116; 62/121; 62/122; 62/500

[58] Field of Search ..... 62/467, 121, 122, 50.2, 62/116, 500

[56] References Cited

U.S. PATENT DOCUMENTS

| | | | |
|---|---|---|---|
| 2,998,465 | 8/1961 | Drummond et al. | 62/121 |
| 3,277,660 | 10/1966 | Kemper et al. | 62/121 |
| 3,426,545 | 2/1969 | Lloyd | 62/50.2 |
| 3,433,850 | 3/1969 | Karkalits, Jr. | 62/121 |
| 3,567,117 | 3/1971 | Eustis | 239/2 |
| 3,672,182 | 6/1972 | Stowasser et al. | 62/121 |
| 3,703,991 | 11/1972 | Eustis et al. | 239/2 |
| 3,773,029 | 5/1973 | Eustis et al. | 239/14 |
| 3,774,842 | 11/1973 | Howell | 239/2 |
| 4,637,216 | 1/1987 | Shenoy et al. | 62/500 |
| 4,724,683 | 2/1988 | Johnson | 62/467 |
| 5,040,373 | 8/1991 | Minovitch | 62/467 |
| 5,216,890 | 6/1993 | Ban et al. | 62/121 |

FOREIGN PATENT DOCUMENTS

| | | |
|---|---|---|
| 2512518 | 3/1983 | France . |
| 2564566 | 5/1984 | France . |

OTHER PUBLICATIONS

"Theoretical & Design Fundamentals of Liquid-Propellant Rocket Engines," 2d Ed., Moscow, Vysshaya, Shkola, 1975, pp. 440–456 (in Russian).

*Primary Examiner*—Ronald C. Capossela
*Attorney, Agent, or Firm*—Collard & Roe

[57] ABSTRACT

A method of gas generation resides in transformation of a cryogenic agent, capable of passing to the supercritical state, from the liquid state to the gaseous state thereof by way of thermoinversion in an isochoric process with enhancement of the potential energy of pressure of the gaseous medium thus obtained, and reducing the shaped gas stream, this being followed by gasdynamic ejection of the ambient medium. A plant for effecting the method comprises a source of a working medium (a cryogenic agent), at least one chamber (1,2), a gas reducer (29) and a gas ejector (24), arranged in succession downstream and communicating with each other.

10 Claims, 5 Drawing Sheets

METHOD OF GAS GENERATION AND PLANT FOR EFFECTING SAME

TECHNICAL FIELD

The present invention relates to mechanical engineering and more particularly to a method of gas generation and to a plant for effecting same.

BACKGROUND ART

At present gas generation is effected by different methods, such as mechanical, thermal, calorific, etc.

Known in the art is a method of gas generation, based on the use of mechanical energy of a fan driven from an internal combustion propulsive device and of adiabatic expansion (acceleration) of an air stream in a gasdynamic subsonic nozzle (U.S. Pat. Nos. 3,567,117; 3,733,029; 3,703,991; 3,774,842).

Said method is noted for simplicity, it can be easily applied for gas generation, and is widely used in plants for producing artificial snow. The implementing of this method, however, involves considerable power expenditures. Furthermore, realization of said method on prior-art plants brings about contamination of the environment with exhausts of the products of incomplete combustion of the chemical fuel of the internal combustion engine.

A method of gas generation is known, based on natural bringing of preliminarily liquefied natural gas to gaseous state under the effect of the ambient temperature. For effecting such a method it is usual to employ a cryogenic agent, which has an ability to pass from the liquid state over to the gaseous one only in the subcritical region, as the working medium. This method is widely used in household appliances, for instance, in portable gas burners. Nevertheless, said method has a very narrow scope of application because of its low energy characteristic and a high explosion hazard presented by the gas stream produced.

Widely known is a method of gas generation, residing in bringing the working medium, coming from a source in the liquid state, over to the gaseous state, this being followed by shaping a gas stream supplied to the consumer.

This method is realized on a plant comprising a source of a working medium, said medium being in the liquid state, said source communicating with a chamber adapted for bringing the working medium to the gaseous state (V. M. Kudryavtsev (Editor), "Osnovy Teorii i Rascheta Zhidkostnykh Raketnykh Dvigatelei"/- Theoretical and Design Fundamentals of Liquid-Propellant Rocket Engines/. Textbook for college students. 2nd edition, revised ad enlarged, Moscow, Vysshaya Shkola, 1975, pp. 440–456 (in Russian)). As working medium a two-component fuel is used, the ratio of its components providing the required gas temperature. Transition of the working medium from the liquid state to the gaseous one takes place as a result of atomizing, i.e. dividing the working medium into drops, distributing thereof in the chamber, warming-up and evaporating drops, liquefying the vapours of the fuel and oxidant; the chemical reaction: the process of burning proper. The gaseous medium obtained by the above-described method is further shaped into a stream and delivered to the consumer, for instance, to a gas turbine.

Said method is characterized by a high working efficiency of the produced gas stream, which enables its effective utilization in various high-energy high-temperature plants, such as internal combustion engines, gas turbine engines, liquid-propellant rocket engines. However, the use of a chemical or organic fuel leads to the production of a gas stream comprising a large quantity of ecologically noxious products of combustion of the fuel components, this feature lowering materially the effectiveness of using said fuel. Furthermore, the components employed in the working medium are costly, whereas improvements in the design of the prior-art plant for the realization of the above method with a view to eliminating harmful exhausts require large capital expenditures.

DISCLOSURE OF THE INVENTION

The present invention is directed to the provision of a method of gas generation with the use of such a working medium, as well as to the provision of a plant for effecting said method with such a structural embodiment, which would enhance considerably the effectiveness of gas generation and improve simultaneously the ecological characteristics of the gas production, which would ensure a broad range of application of said method and plant.

Said object is accomplished by that in a method of gas generation, residing in transforming a working medium, coming from a source in the liquid state, to the gaseous state, with subsequent shaping of a gas stream to be supplied to a consumer, according to the invention, as the working medium use is made of a cryogenic agent capable of passing over to the supercritical state, whose bringing over from the liquid to the gaseous state is effected by way of thermoinversion in an isochoric process with an increase in the potential energy of pressure of the produced gaseous medium, the shaped gas stream, prior to delivery thereof to the consumer, being additionally reduced, this being followed by gasdynamic ejection of the ambient medium.

For broadening the scope of application of the present method, for instance, for separating with the help thereof a solid phase from a liquid phase, for example, a salt from an aqueous solution, it is necessary after carrying out gasdynamic ejection of the ambient medium to inject additionally an atomized liquid medium into the gas stream.

In those cases when it is necessary to produce artificial snow, it is necessary to use water as the liquid medium.

The herein-proposed method of the invention enables a considerable enhancement of the gas generation effectiveness due to the use of a cryogenic agent as the working medium, the efficiency of said agent exceeding the thermal efficiency of any chemical reaction, even of the highest-energy fuel, this feature rendering the present method ecologically pure. In addition, the method proposed herein is highly economical, compared to the prior-art methods, due to the use of a cheap, easily available and restorable working medium.

The object set forth is accomplished by that in a plant for gas generation, comprising a source of a working medium in the liquid state, communicated with at least one chamber adapted to transform the working medium from the liquid state to the gaseous state, said chamber having an outlet pipe communicated with a consumer, according to the invention, a cryogenic agent is used as the working medium, said cryogenic agent being capable of passing to the supercritical state, said outlet pipe of the chamber being communicated with said consumer through a gas reducer and a gas ejector, communicating with each other and arranged in succession downstream behind the chamber.

For raising the efficiency of the plant operation, it is reasonable that the gas ejector be provided with a controlled interrupter of the gas stream.

It is expedient that the plant should be additionally provided with at least one nozzle, communicated with the source of the liquid medium and installed on the diffuser exit section of the gas ejector.

Such a structural embodiment makes the present plant suitable for separating a solid phase from liquid solutions, for instance, for producing artificial snow.

To provide nonfreezing of the nozzles and raise the efficiency of atomizing the liquid medium, it is reasonable that each nozzle should be additionally communicated with an air compressor.

It is reasonable that the air compressor should be driven by a gas turbine, arranged on the air pipeline that communicates the outlet pipe of the gas reducer with the inlet nozzle of the gas ejector.

Such a structural embodiment will make it possible to ensure both autonomous operation of the plant and an automatic control thereof.

It is expedient that the proposed plant be provided additionally with a gas turbine arranged at the outlet from the gas ejector and kinematically linked with an actuating member.

This broadens appreciably the scope of application of the herein-proposed plant due to the use thereof as a drive for various power devices.

For ensuring autonomous operation of the proposed plant, when it has to function under such conditions that there is no stationary source of the cryogenic agent nearby, it is reasonable that said plant be additionally provided with a gas medium liquefier, communicated with the source of the working medium.

The proposed plant for gas generation, embodied according to the invention, features a comparatively low energy intensity due to efficient utilization of the total energy of the cryogenic agent, it does not generate harmful by-products or ecologically harmful products, it does not use chemical or organic substances. Moreover, the plant is reliable in operation, has a longer service life thanks to a radical reduction of the number of moving parts and high-temperature units, and in some cases complete obviation thereof, compared with prior-art analogs. The overall dimensions of the plant are relatively small, it is compact and can operate both from a stationary source of the working medium and autonomously. The plant proposed herein, due to its design features, has a broad field of application and can be used for producing artificial snow, as a refrigerating plant, and also as a drive for various power devices.

BRIEF DESCRIPTION OF THE DRAWINGS

The present invention will now be explained by a detailed description of exemplary embodiments with reference to the accompanying drawings, in which.

EMBODIMENT OF THE INVENTION

The method of gas generation according to the present invention resides in transformation of a working medium, which is in the liquid state, to the gaseous state, and in subsequent shaping of a gas stream to be delivered to a consumer. As the working medium in the herein-proposed method use is made of a cryogenic agent, for example, liquid air, which is transformed from the liquid to the gaseous state with supercritical parameters by way of thermoinversion in an isochoric process with an enhancement of the potential energy of the resulting gaseous medium. The shaped gas stream, prior to delivery thereof to the consumer, is additionally reduced, this being followed by gasdynamic ejection of the ambient medium.

Figure 1:
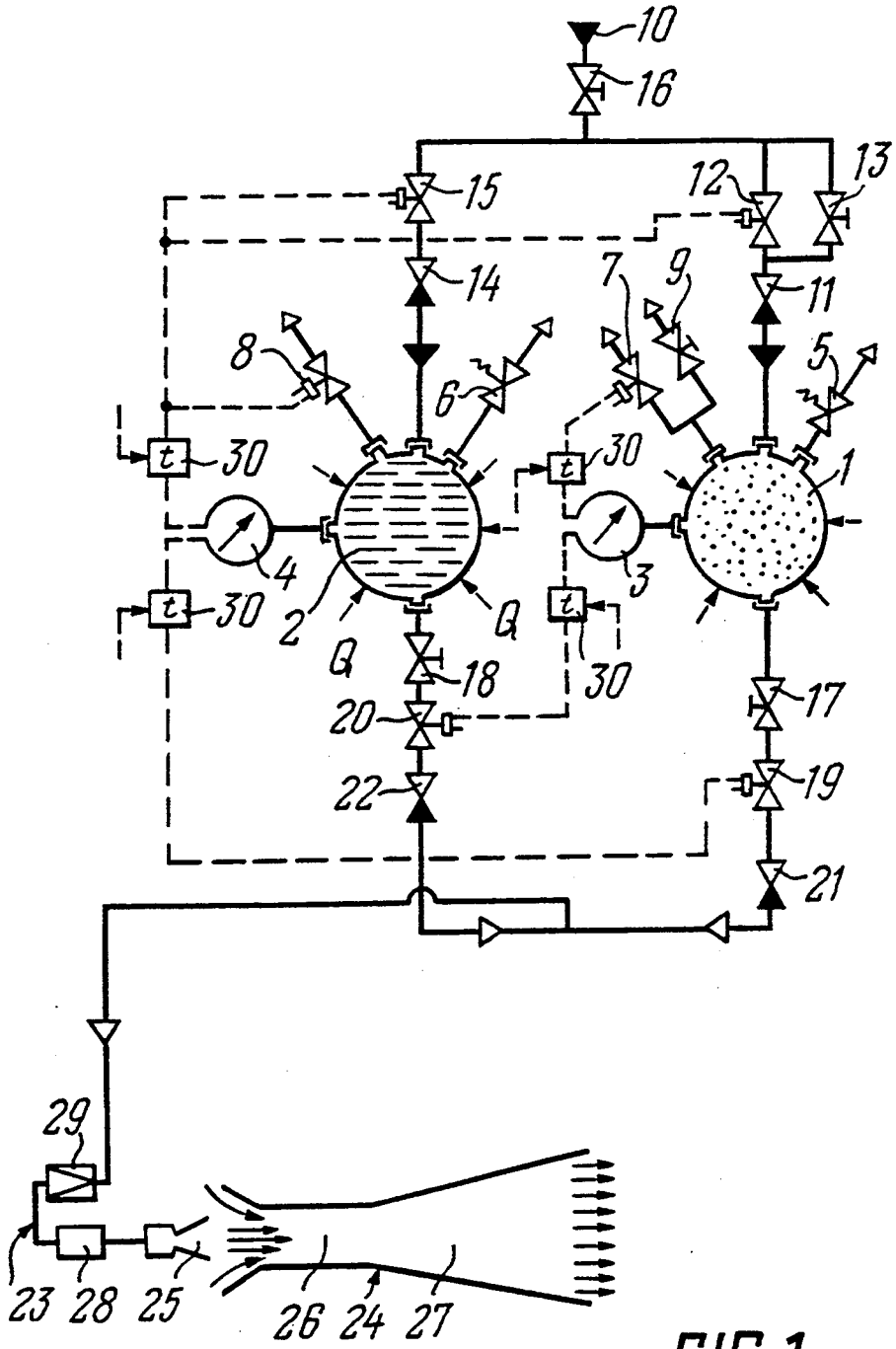
FIG. 1 shows diagrammatically a plant for gas generation, according to the invention.

The above-described method is realized on the herein-proposed plant, comprising at least one chamber, in this specific exemplary embodiment it comprises two chambers 1,2 (FIG. 1), adapted for transforming the working medium from the liquid state to the gaseous one. Each chamber 1,2 is a thermally non-insulated thin-walled vessel manufactured from a high-strength material having a high thermal conductance. The chambers 1,2 are provided with electric contact pressure gauges 3 and 4, safety valves 5,6, and drain valves 7 and 8 respectively, the chamber 1 being provided also with a drain valve 9. Each of the chambers 1,2 from one side is communicated with a filling pipeline 10. The chamber 1 is communicated with said pipeline through a check valve 11, an electric valve 12, and a valve 13 arranged parallel to the electric valve 12, whereas the chamber 2 is communicated with said pipeline 10 only through a check valve 14 and an electric valve 15. The filling pipeline 10, communicated with a source of the working medium, e.g., with a transportation tank (not shown in the drawing), is provided with a valve 16, serving for initial filling of the chambers 1,2.

From the other side each of the chambers 1,2 is communicated through valves 17,18, electric valves 19,20, and check valves 21,22, respectively, with a delivery pipeline 23.

The working gas stream is shaped in the present plant with the help of an ejector 24, comprising an inlet nozzle 25, a mixing chamber 26, and a diffuser 27. For raising the efficiency of operation of the ejector 24, it is provided with a controlled interrupter 28 of the gas stream, arranged in front of the inlet nozzle 25. The delivery pipeline 23 is communicated with the inlet nozzle 25 of the gas ejector 24 through a gas reducer 29.

The plant is provided with time relays 30 powered from the electric supply mains.

The proposed plant for gas generation operates in the following manner.

Figure 2:
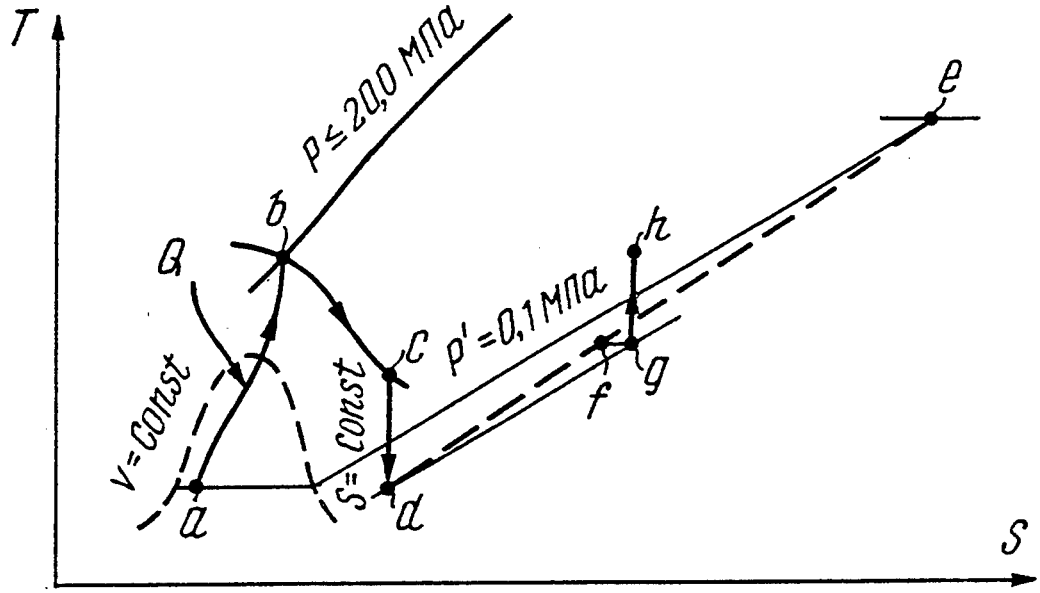
FIG. 2 is a graphic presentation of the gas generation cycle according to the proposed method in a T-S diagram.

Liquid air or some other cryogenic agent of "gaseous nature", having the temperature $T=-190°$ C., comes from a source (not shown), for instance, from a transportation tank, along the filling pipeline 10 through the valves 13 and 16, the check valves 11 or 14 and the electric valves 12 or 15 to one of the chambers, for example, to the chamber 1, which is precooled with the use of the valve 9 or of the electric valve 7. In the chamber 1, shut off by the electric valves 7,12,19 and by the valve 9, liquid air evaporates under the effect of the heat Q of the ambient medium; the pressure and temperature grow. In FIG. 2 this isochoric process is shown with curve ab. The working pressure set up in the chamber 1 (FIG. 1) depends on the intensity of supply of the external heat Q of the ambient medium and on the delivery characteristic of the pipeline 23 feeding the gas ejector 24.

When the working pressure and the temperature in the chamber 1 become P=10–20 MPa and T=−80°–100° C. respectively, gasified air through the open valve 17, the electric valve 19, and the check valve 21 comes through the delivery pipeline 23 to the inlet of the gas reducer 29. In the course of operation at a variable high pressure P=10–20 MPa at the inlet to the gas reducer 29 a constant low pressure P′=0.2–0.5 MPa is maintained at the outlet thereof. In FIG. 2 this isoenthalpic process is illustrated by segment bc. At this pressure air through the controlled interrupter 28 of the gas stream (FIG. 1) comes to the gas ejector 24 through the (subsonic or supersonic) inlet nozzle 25. While passing through the inlet nozzle 25, the air expands (isoentropic process cd in FIG. 2), and a considerable degree of rarefaction is attained at the inlet to the mixing chamber 26 (FIG. 1), as a result of which an appreciable quantity of air (depending on the throttling characteristic of the gas ejector 24) is admixed to the active stream of air from the ambient medium.

As a result of intensive intermixing of the active air coming from the pipeline 23 and passive air coming from the ambient medium, there is formed a thermodynamically and mechanically equilibrium, homogeneous air mixture, having a prescribed temperature, as is illustrated by segment d-e-f-g in the T-S diagram presented in FIG. 2. The resulting air mixture, passing through the diffuser 27 (FIG. 1), having lowered its speed to ≈10 m/s and the pressure to ≈0.13 MPa (the process shown in the plot by segment gh (FIG. 2)), is either discharged from the gas ejector 24 (FIG. 1) with the corresponding reserve of momentum to the atmosphere or delivered to the consumer.

As regasified air is gradually produced in the chamber 1 with the help of an automatic control system, in which the electric contact pressure gauges 3 and 4, the electric valves 12,15,19 and 20, and the time relays 30 are actuated, filling of the chamber 2 with liquid air is effected. In each of the chambers 1 or 2 a prescribed range of pressure variation is maintained to ensure continuous and steady operation of the plant for gas generation. The automatic control system is powered from the mains. Manual control of the present plant can also be effected with the aid of the valves 9,16,17,18 and the safety valves 5,6.

The proposed method of gas generation can be used for displacing a solid phase from a liquid medium, for instance, a salt from aqueous solutions, or for producing artificial snow. For this to be done, after carrying out gasdynamic ejection of the ambient medium, an atomized liquid medium, e.g., water is additionally injected into the gas (air) stream for producing artificial snow.

Figure 3:
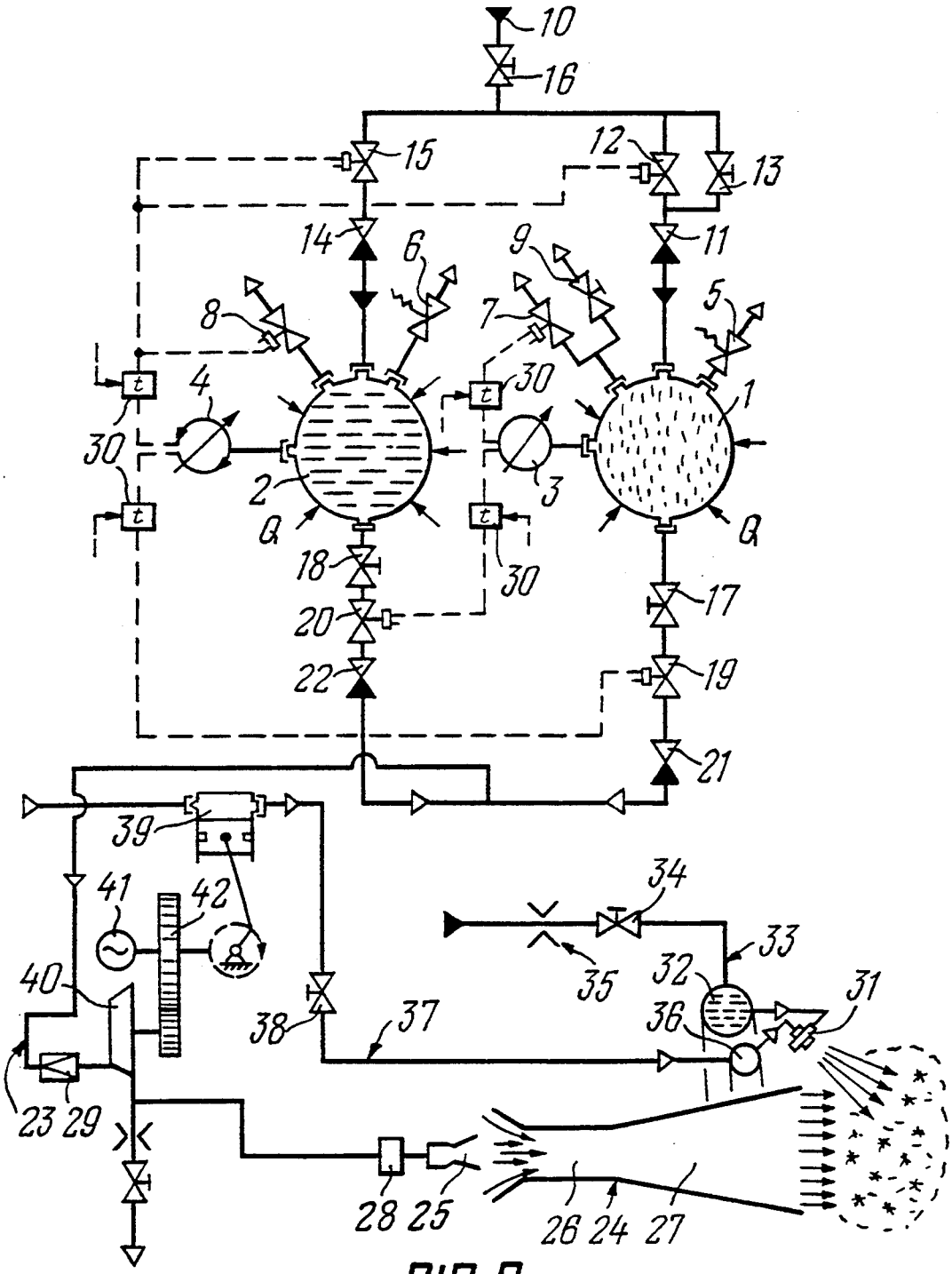
FIG. 3 shows diagrammatically a plant for gas generation, according to the invention, used for producing artificial snow.

Structurally this is accomplished due to the fact that the plant made according to the invention additionally comprises at least one nozzle 31 (FIG. 3) which is mounted on the exit section of the diffuser 27 of the gas ejector 24. Each nozzle 31 is communicated with a water manifold 32 which is fed with water from a water supply system through a pipeline 33 with a valve 34. The pipeline 33 may be provided with adjustable orifice restrictors 35. Furthermore, for precluding freezing of one nozzle 31 or the whole bank of the nozzles 31, as well as for increasing the efficiency of atomizing the liquid medium, each nozzle 31 is additionally communicated with an air manifold 36, which, through an air manifold 37 provided with a valve 38, is communicated with an air compressor 39. The air compressor 39 is driven by a gas turbine 40 installed within the span of the delivery pipeline 23, that communicates the outlet pipe of the gas reducer 29 with the inlet nozzle 25 of the gas ejector 24. The gas turbine 40 through a reducer 41 drives an electric generator 42 and the air compressor 39. The electric generator 42 serves for powering the elements of the automatic control system.

The plant having the above-described structural embodiment operates in the following manner.

Figure 4:
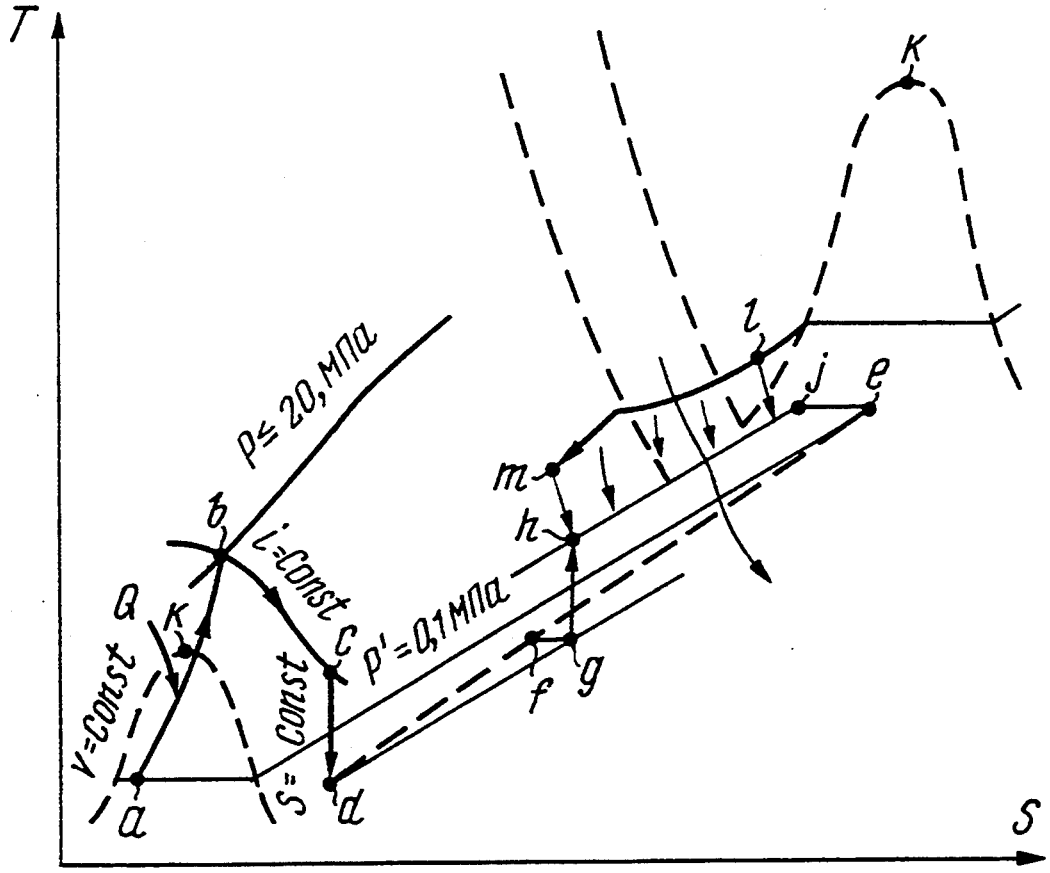
FIG. 4 is a graphic presentation of the artificial snow production cycle according to the proposed method in a T-S diagram.

After a gas stream has been shaped in accordance with the above-described method at the exit section of the diffuser 27 of the gas ejector 24, finely dispersed water is injected thereinto through the bank of the nozzles 31. As a result of intensive heat and mass transfer in the strongly turbulized air stream (including ambient air), the quantity of heat, required for converting fine droplets of water into snow, is abstracted from said droplets. This isobaric process is shown in the T-S diagram by segment in (FIG. 4). The snow thus formed falls out along the wake of the air jet.

Figure 5:
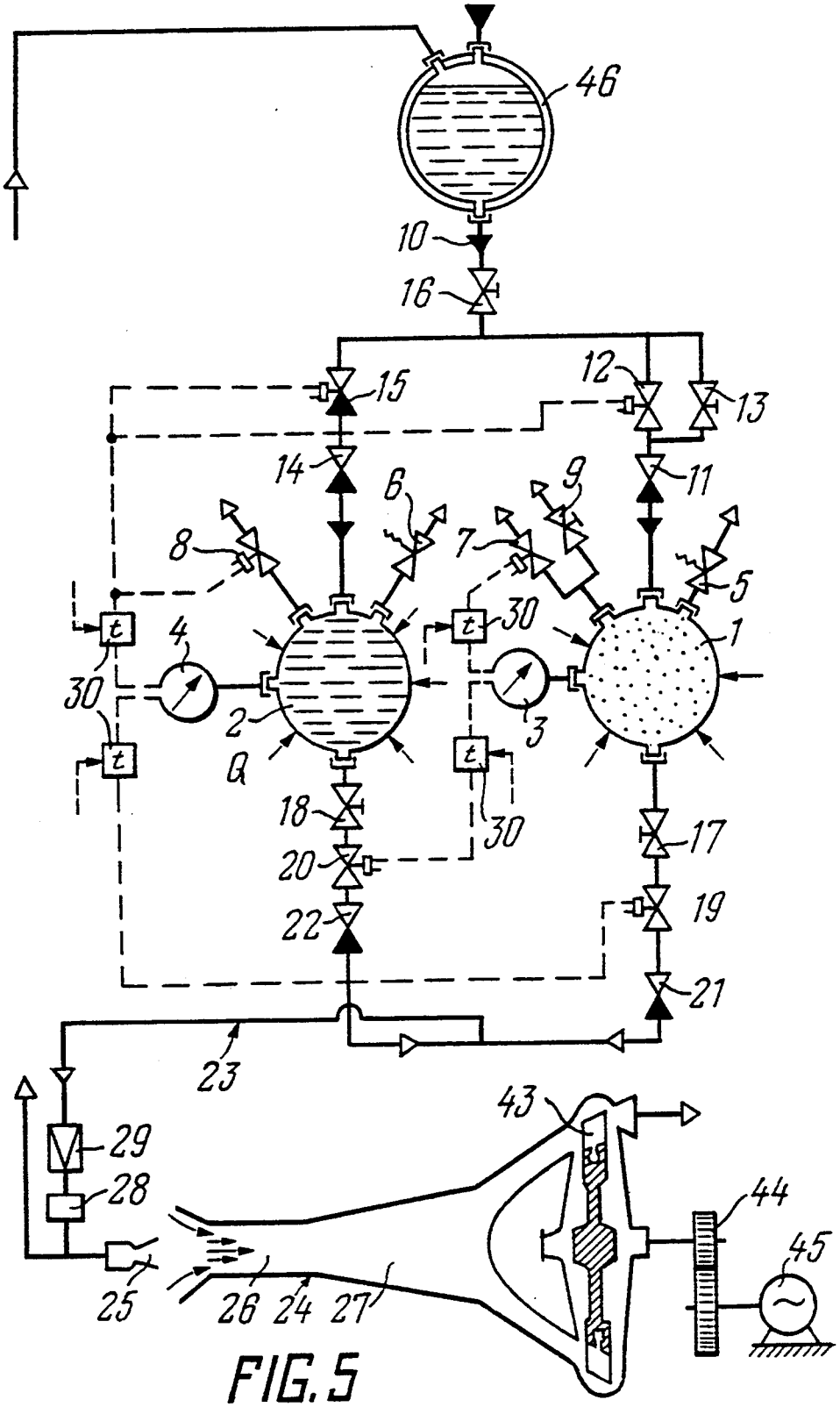
FIG. 5 shows diagrammatically a plant for gas generation according to the invention, used as a cold gas turbine engine.

Owing to its structural features the plant proposed herein has a broad field of application and can be used, as described above, as a refrigerating plant or as a plant for producing artificial snow; besides, this plant can serve as a drive for various power devices. The latter application, in particular, is secured by that the proposed plant is provided with an additional gas turbine 43 (FIG. 5) arranged at the outlet of the gas ejector 24. The shaft of the additional gas turbine 43 is kinematically linked with an actuating member, e.g. through a step-down reducer 44, with an electric generator 45. In this structural embodiment of the proposed plant the source of the working medium is a specially designed accumulator 46 of the cryogenic agent.

Transformation of the cryogenic agent, e.g., liquid air, to the gaseous state and formation of the gas stream in the plant of the proposed structural embodiment are performed in a manner similar to that described hereinabove. A homogeneous air stream formed in the mixing chamber 26 of the gas ejector 24 comes through the diffuser 27 to the blades of the additional gas turbine 43 with an elevated pressure and a corresponding reserve of momentum, and then it is discharged to the atmosphere. The power from the additional turbine 43 is transmitted through the step-down reducer 44 to the electric generator 45. This structural embodiment of the plant provides an ecologically safe engine having a simple design, which operates only on the principle of the temperature gradient between the cryogenic agent and the ambient medium.

Figure 6:
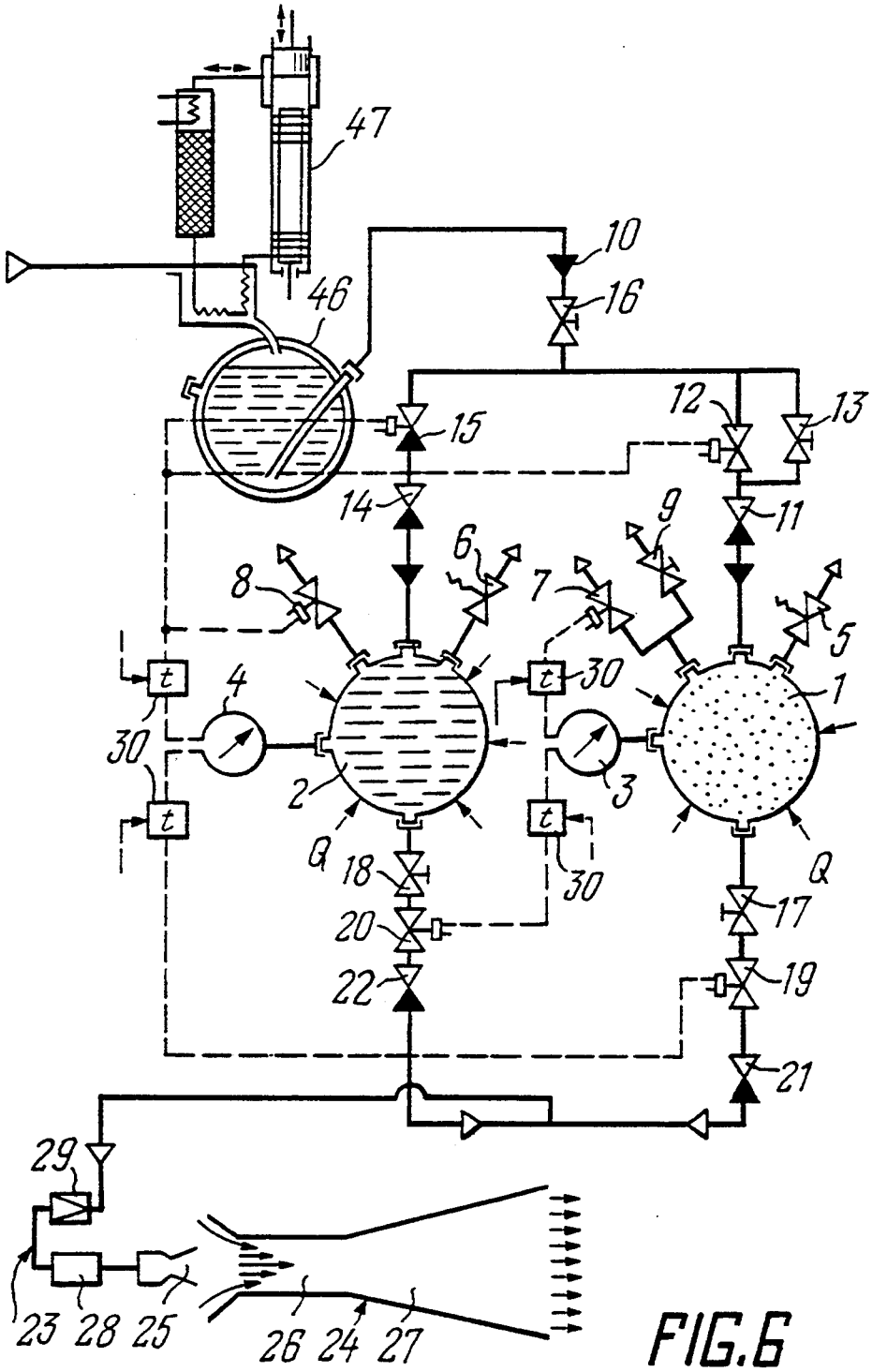
FIG. 6 shows diagrammatically a plant for gas generation according to the invention, used for producing a cold gas stream.

For ensuring autonomous operation of the proposed plant when the latter has to function under the conditions of there being no stationary source of the cryogenic agent nearby, the plant is additionally provided with a liquefier 47 of the gaseous medium (FIG. 6), said liquefier working in accordance with the closed Stirling cycle and being communicated with the accumulator 46 of the cryogenic agent.

This version of the structural embodiment of the proposed plant operates as follows.

As the plant is started, air from the atmosphere flows to the liquefier 47 by gravity, is liquefied therein, and the resulting liquid air is collected in the accumulator 46 of the cryogenic agent, constituting a safety reserve thereof (for taking preventive measures with a view to defrosting the conduits of the liquefier 47, contemplated making up of peak loads in cold production, and the like). From the accumulator 46 liquid air having the temperature T = −190° C. comes to the filling pipeline 10. After that the process is effected as described hereinabove.

Industrial Applicability

The present invention will find most effective application in refrigerating engineering for producing cold, artificial snow, or air conditioning, as well as for fractionating liquid solutions. Furthermore, the present invention can be used as a propulsive device in indirect-action propulsion systems, for use both in transport vehicles and when working in mines, cargo holds, and the like.

We claim:

1. A method of gas generation, comprising:

placing a cryogen working medium, fed from a source in a liquid phase, in a defined enclosure of space;

placing said defined enclosure in the surrounding medium having parameters providing thermal inversion in an isochoric process until a gaseous fluid having an increased potential pressure energy is obtained;

reducing said gaseous fluid followed by gas-dynamic ejecting of said fluid so as to form a gas flow therefrom having preset parameters; and delivering said gas flow thus formed to a consumer.

2. A method according to claim 1, comprising:

injecting an atomized liquid medium into said gas flow, said injecting following the step of gas-dynamic ejecting of the surrounding medium.

3. A method according to claim 2, comprising:

using water as said liquid medium.

4. A system for providing gas generation, comprising:

a source of cryogen;

at least one chamber communicating with said source of cryogen, said chamber defining a bounded space for said cryogen and being placed in the surrounding medium having the parameters providing thermal inversion in an isochoric process, said chamber producing a gaseous fluid having an increased potential pressure energy;

an outlet connection on said chamber;

a gas pressure reducer situated downstream of said chamber in the direction of the gaseous fluid discharge;

an inlet connection of said gas pressure reducer, said inlet connection of said reducer communicating with said outlet connection of said chamber; and a gas ejector situated downstream of said gas pressure reducer in the direction of the gaseous fluid discharge and communicating with said reducer, said gas ejector forming a gas flow from said gaseous fluid, said gas flow having preset parameters, and said gas ejector delivering said gas flow to a consumer.

5. A system according to claim 4, further comprising:

a controlled gas flow interrupter located in said gas ejector.

6. A system according to claim 5, further comprising:

at least one spray nozzle for feeding liquid medium;

said ejector shaped as a diffuser, and said diffuser housing an exit section; and said liquid medium feeding spray nozzle being situated adjacent to said exit section of said diffuser.

7. A system according to claim 6, further comprising:

an air compressor communicating with said spray nozzle and having its own power actuator.

8. A system according to claim 7, wherein a gas turbine is the power actuator of said air compressor, and further comprising:

an air pipeline;

an inlet nozzle of said gas ejector; and an outlet connection of said gas pressure reducer, said air pipeline establishing communication between said outlet connection of the gas pressure reducer and said inlet nozzle of the gas ejector, said gas turbine being located on said air pipeline.

9. A system according to claim 4, further comprising:

another gas turbine located at the outlet of said gas ejector and associated with an executing member.

10. A system according to claim 4, further comprising:

a gaseous fluid liquefier communicating with the source of cryogen.

* * * * *